US007412813B2

(12) United States Patent
Heil et al.

(10) Patent No.: US 7,412,813 B2
(45) Date of Patent: Aug. 19, 2008

(54) DEVICE AND METHOD FOR FIXING CLOSING FILMS TO POURING ELEMENTS ARRANGED ON COMPOSITE PACKAGES

(75) Inventors: Michael Heil, Mönchengladbach (DE); Thomas Vetten, Düsseldorf (DE)

(73) Assignee: SIG Technology Ltd., Neuhausen am Rheinfall (CH)

( * ) Notice: Subject to any disclaimer, the term of this patent is extended or adjusted under 35 U.S.C. 154(b) by 5 days.

(21) Appl. No.: 10/555,999

(22) PCT Filed: Aug. 4, 2004

(86) PCT No.: PCT/EP2004/008726

§ 371 (c)(1),
(2), (4) Date: Nov. 8, 2005

(87) PCT Pub. No.: WO2005/016758

PCT Pub. Date: Feb. 24, 2005

(65) Prior Publication Data

US 2006/0213151 A1 Sep. 28, 2006

(30) Foreign Application Priority Data

Aug. 8, 2003 (DE) ..... 103 36 788

(51) Int. Cl.
*B65B 7/28* (2006.01)
*B65B 51/10* (2006.01)
*B67B 3/04* (2006.01)

(52) U.S. Cl. ..... 53/487; 53/415; 53/296; 53/299; 53/329.2

(58) Field of Classification Search ..... 53/478, 53/477, 296, 299, 304, 303, 307, 314, 329.2, 53/329.3, 129.1, 415, 131.1, 487
See application file for complete search history.

(56) References Cited

U.S. PATENT DOCUMENTS 2,680,549 A * 6/1954 Levy ..... 53/295
3,939,625 A * 2/1976 Remele et al. ..... 53/131.3
4,065,909 A * 1/1978 Mueller ..... 53/420
4,176,507 A * 12/1979 Mancini ..... 53/478
4,238,267 A * 12/1980 Konstantin ..... 156/379.6

(Continued)

FOREIGN PATENT DOCUMENTS

EP 0 505 388 B1 9/1992

(Continued)

*Primary Examiner*—Rinaldi I. Rada
*Assistant Examiner*—Paul Durand
(74) *Attorney, Agent, or Firm*—The Webb Law Firm

(57) ABSTRACT

Shown and described are a device and a method for securing closure films to pouring elements arranged on composite packages with a cyclic or phased conveying device for conveying the closure films, with a feed device, with a welding device, and with a transport device for transporting the composite packages. In order to allow closure films to be secured reliably and rapidly to pouring elements on the composite packages during the manufacturing process, the welding device is arranged above the transport device, the feed device exhibits at least one clamping device for taking up the closure films and is arranged so as to be movable between a take-up position and a welding position, and the take-up position is turned towards the phased conveying device and the welding position is turned towards the transport device.

27 Claims, 2 Drawing Sheets

U.S. PATENT DOCUMENTS

| | | | | | |
|---|---|---|---|---|---|
| 4,250,686 | A | * | 2/1981 | Fujio | 53/296 |
| 5,371,996 | A | * | 12/1994 | Ueda et al. | 53/298 |
| 5,493,849 | A | * | 2/1996 | Itoh | 53/489 |
| 5,715,651 | A | * | 2/1998 | Thebault | 53/399 |
| 5,890,349 | A | * | 4/1999 | Heisler et al. | 53/485 |
| 6,199,347 | B1 | | 3/2001 | Muller et al. | |
| 6,684,604 | B2 | | 2/2004 | Luc et al. | |

FOREIGN PATENT DOCUMENTS

| | | |
|---|---|---|
| GB | 2 071 566 A | 9/1981 |

* cited by examiner

DEVICE AND METHOD FOR FIXING CLOSING FILMS TO POURING ELEMENTS ARRANGED ON COMPOSITE PACKAGES

BACKGROUND OF THE INVENTION

1. Field of the Invention

The present invention relates to a device and a method for the securing of closure films on pouring elements arranged on composite packages, in particular on beverage packages.

2. Discussion of the Present Technology

Composite packages, especially for beverages, are today frequently provided with what are referred to as pouring elements, in order to allow for such packages to be opened and closed again. In order to ensure that the packages can be reliably closed again after being opened for the first time, use is often made for this purpose of screw closure elements in particular. The problem arises with screw closure elements, however, as with the other pouring elements used, that in the closed state they do not exhibit a very high degree of gas tightness. The result of this is that it is possible that gases may pass from the outside through the closure element into the interior of the package, and so impair the preservation of the content of the package. Under certain circumstances this may mean that the long storage life times desired by the manufacturers can no longer be guaranteed. Likewise, loss of quality and/or aroma of the filled product may be incurred by migration from the inside to the outside.

It has therefore proved necessary for the pouring openings of the pouring elements beneath the cover element to have a closure film drawn over them and in this way for them to be closed so as to be gas-tight. To this end, it is possible for a film to be sealed over the opening for the pouring element on the inside of the package, which is perforated the first time the package is opened. As an alternative to this, it is also possible for the pouring opening of the pouring element to be provided itself with a closure film, which seals the pouring opening. In the case of a screw closure, the cover element is only screwed on after this closure film has been applied. A pouring element of this type is known, for example, from EP 0 505 388 B1.

In particular in cases in which it is intended that the packages are to be filled under aseptic conditions, it is desirable for the closure film not to be applied to the pouring opening after the filling, but to be secured beforehand in the area of the pouring element and for the pouring opening to be closed tight with the closure film immediately after sterilization and filling. The result of this is that the side turned towards the package contents in particular will be sterilized together with the closure film.

The problem arises in this situation, however, that it is necessary for the closure film to be reliably secured before filling to the pouring element in such a way that, on the one hand, subsequent sealing of the pouring opening is possible without any difficulties and, on the other, the securing of the closure film does not unnecessarily impede or delay the manufacturing process of the packages. In addition to this, it is necessary for the filling of the package to be possible with the closure film already secured.

BRIEF SUMMARY OF THE INVENTION

Taking this as a basis, the present invention is based on the problem of providing a device and method of the type referred to in the preamble and described in greater detail heretofore, with which it is possible for closure films to be secured reliably and rapidly to pouring elements arranged on the composite packages during the manufacturing process.

In terms of the device, this problem is resolved by a device with a phased conveying device for the conveying of closure films, with a feed device, with a welding device, and with a transport device for the transport of composite packages, whereby the welding device is arranged above the transport device, whereby the feed device exhibits at least one clamping device for taking up the closure films and is arranged so as to be movable between a take-up position and a welding position, and whereby the take-up position is turned towards the phased conveying device and the welding device is turned towards the transport device.

The closure films are rendered into single pieces with the phased conveying device and conveyed to the feed device. The clamping device provided in each case holds a closure film, which in the take-up position is handed over from the cyclic conveying device to the clamping device. The closure film is then brought into the welding position by the movement of the feed device. By means of the transport device, the composite packages, provided with pouring elements, are likewise transported into the area of the welding position, so that it is then possible for the closure films, rendered as single pieces, to be secured to the pouring element by means of the welding device. When the closure film has been secured to the pouring element, the clamping device releases the closure film, and the feed device can move back into the take-up position, in order to take up another closure film for the next pouring element.

Accordingly, in the first instance the phased conveying device allows for the closure films, which, if appropriate, are fed in continuously, to be rendered as single pieces. By means of the clamping device, which is provided at the feed device, the closure film can be moved to the pouring element in a defined position, so that the position which the closure film adopts after securing is unambiguously determined.

According to a further teaching of the invention, the clamping device extends in the welding position in the direction of the mid-axis of the opening of the pouring element arranged on the composite packages and parallel to it. As a result, the situation is reached in which the closure films are secured projecting at right angles to the plane of the opening, and therefore do not cause interference during subsequent sterilization and filling.

In another preferred embodiment the feed device exhibits a lever arm, which is capable of pivoting about an axle, and at the free end of which, turned away from the axle, the clamping device is arranged. This accordingly allows, by means of a simple pivoting movement, for the clamping device to adopt both the take-up position as well as the welding position. The axle is for preference arranged at right angles to the direction of transport of the composite packages and in a plane parallel to the transport plane.

A further embodiment of the invention makes provision for the feed device to exhibit several lever arms, connected to the axle in a rotatable manner, which are arranged in a star shape. The result of this is that, while closure films which have already been taken up are being conducted to the welding position, further closure films can be transferred to the clamping devices, so that a higher cyclic rate can be achieved with the securing of the closure films.

In a further preferred embodiment, the clamping devices are designed in such a way that clamping jaws are provided which can be moved backwards and forwards between a closed and an open position, whereby this is effected, for further preference, by pneumatic means. By means of such an arrangement, a reliable clamping device is provided which is easily actuatable by means of the pneumatics.

Another teaching of the invention makes provision for the lever arms to exhibit a centering pin in the area of the clamping devices, with which the pouring element can be positioned relative to the closure film during securing. This ensures that the closure film is secured in a precisely defined position relative to the pouring element.

If a cutting device is provided between the phased conveying device and the feed device, the closure films can be conveyed as a strip from the roll by the phased conveying device, and the rendering of the closure films into single pieces is only effected by the cutting device once it has been secured in the clamping device.

A further teaching of the invention makes provision for a stamping device to be located upstream of the phased conveying device, so that the strip material for the closure film can be adapted to the desired shape inside the device according to the invention. Accordingly, any desired strip material can be used.

According to a further preferred embodiment, the transport device is designed in such a way that composite packages with the pouring elements arranged on top can be conveyed by it standing upright. As a result of this, it is possible for the closure films to be secured directly before sterilization and later filling of the composite packages, so that the secured closure films are only subjected to the risk of damage for a short period of time.

In a further preferred manner, the directions of movement of the clamping devices and of the transport device run parallel to one another in the area of the transport device, as a result of which the risk can be avoided of pouring elements colliding with closure films during infeed, which could damage the closure films or at least deform them. In this situation it is further preferred for the transport device to exhibit rails for the parallel alignment and guidance of the pouring element and the closure films. As a result of the rails, the risk is avoided of the closure films coming in contact with the pouring element during the feeding movement, which could likewise lead to damage to the closure films.

In order to be able to control the movement of the transport device and the movement of the feed device depending on one another, provision is made in a further embodiment of the invention for a sensor for detecting a pouring element entering the transport device.

In particular for situations in which material in strip form is being used for the closure films, it is preferred for the phased conveying device to exhibit two conveying rollers arranged parallel-to one another. On the one hand, this allows for a precise positioning of the strip material and, on the other, it represents a less elaborate design. As strip material, aluminium foil is used for preference.

With regard to the method, the problem is resolved by the following steps:

- Infeed of strip material,
- Punching or stamping of closure films out of the strip material,
- Conveying the closure films and rendering them as individual pieces,
- Securing the closure film in a clamping device, which is located in a take-up position,
- Feeding the closure film from the take-up position into a welding position,
- Transport of a composite package with a pouring element into the area of the welding position,
- Securing of the closure film to the pouring element by means of a welding device, and release of the closure film by the clamping device.

Other preferred embodiments of the method are described in the Sub-Claims.

DESCRIPTION OF THE DRAWINGS.

The invention is described hereinafter on the basis of drawings representing solely a preferred embodiment. The drawings show.

DETAILED DESCRIPTION OF THE INVENTION.

Figure 1:
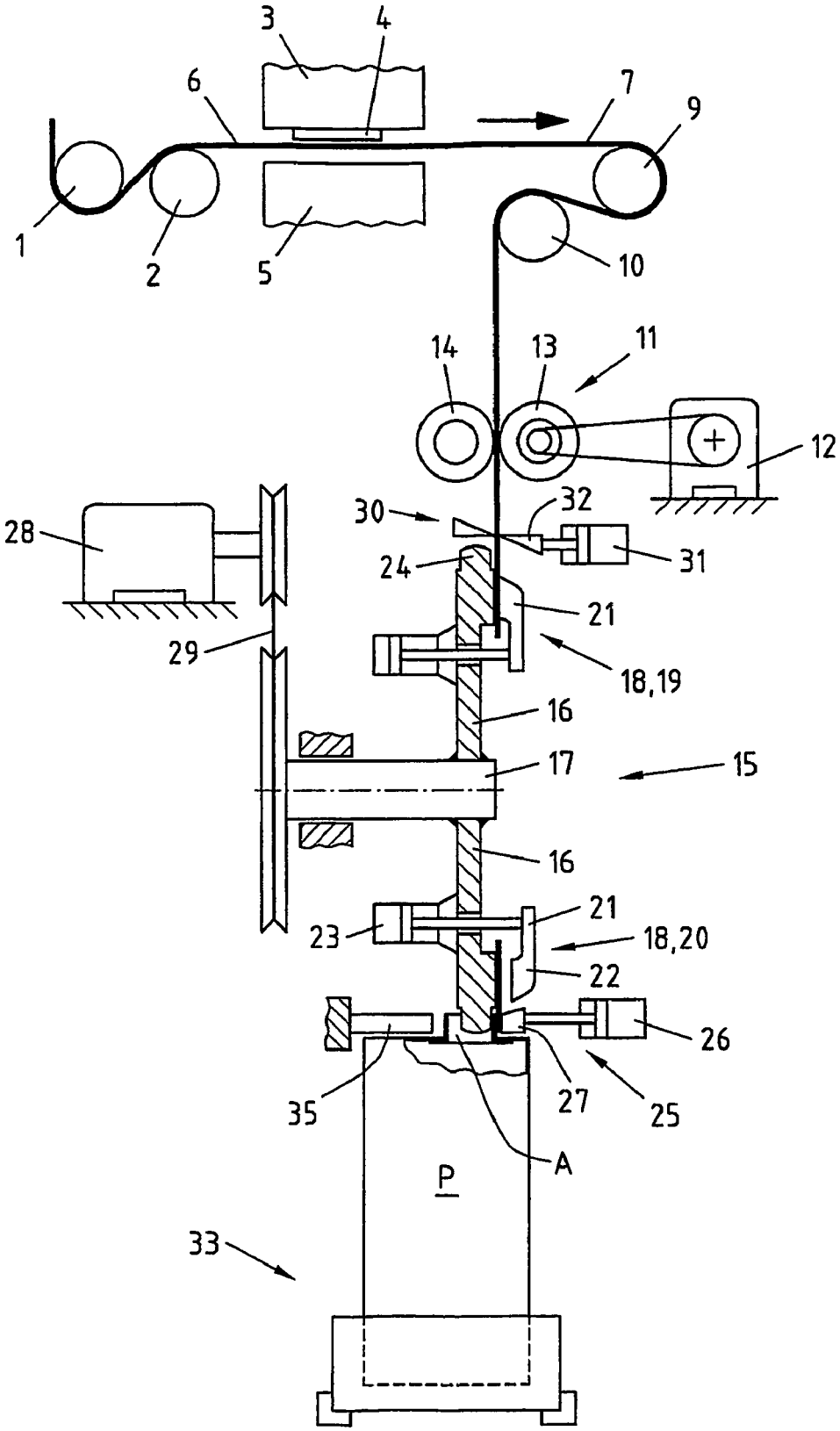
FIG. 1 A device according to the invention, shown in diagrammatic form in a partially sectional side view, and FIG. 2 The device according to the invention, in diagrammatic form in a frontal view.
Figure 2:
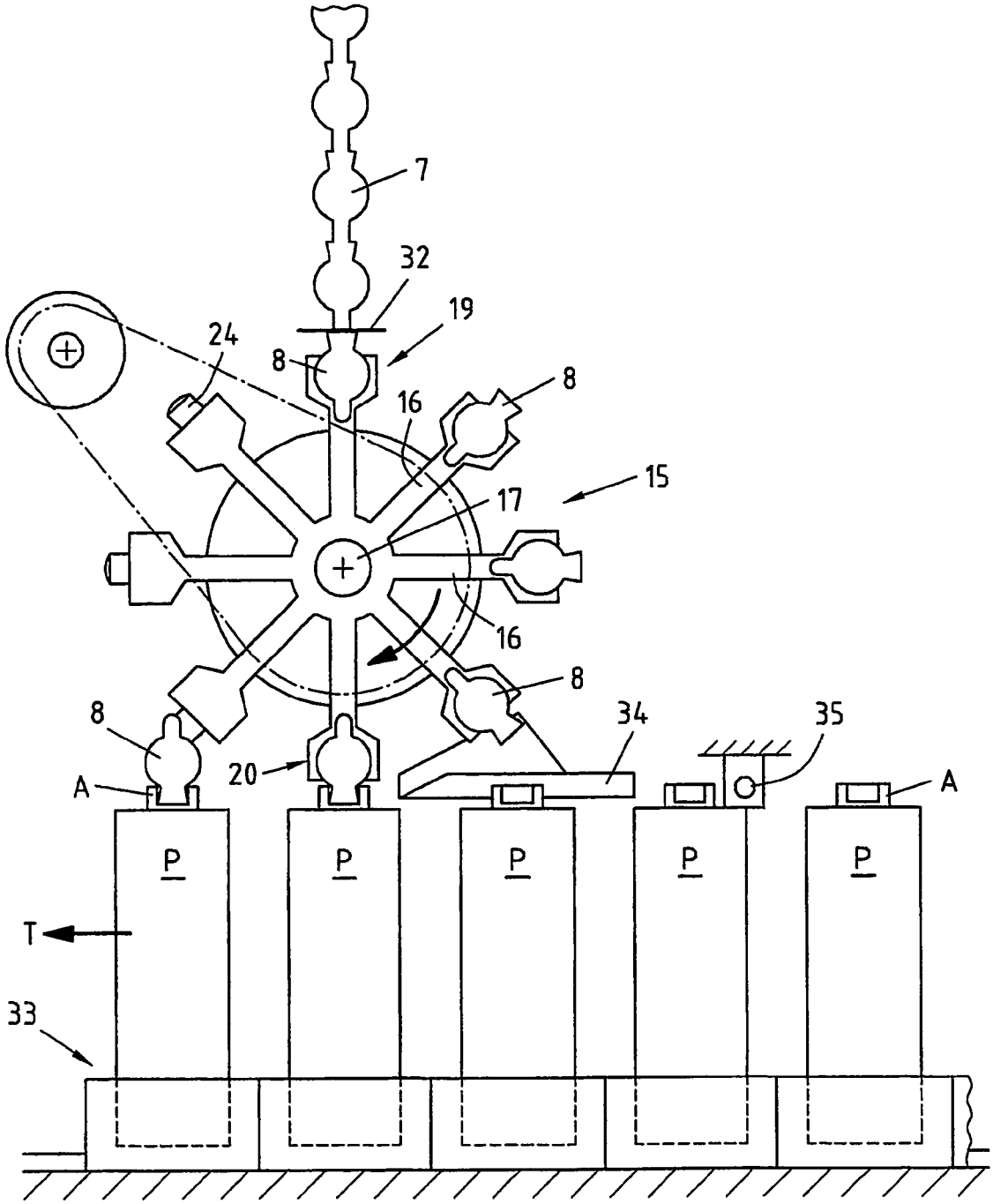

The device according to the invention exhibits a frame, not represented, whereby in the upper part of the frame a punching device 3 is arranged, indicated only diagrammatically. The punching device 3 exhibits a punching plate 4 and a punching block 5 arranged beneath this. By means of a punching cylinder, not shown, the punching plate 4 can be pressed onto the punching block 5. In this situation, a strip material 6 is guided via deflection rollers 1 and 2 between the punching plate 4 and the punching block 5, from which a closure film strip 7 is punched out by means of the punching device 2, this strip still consisting of closure films 8 connected to one another, as can clearly be seen from FIG. 2.

The closure film strip 7 is guided via deflection rollers 9 and 10 to a phased conveying device 11, whereby the phased conveying device 11 is arranged beneath the stamping device 3 and the deflection rollers 9 and 10.

The phased conveying device 11 exhibits a motor 12 and two conveying rollers 13 and 14 which are driven by this. The closure film strip 7 is guided between the first conveying roller 13 and the second conveying roller 14. With the actuation of the motor 12, the closure film strip 7 is conveyed onwards through the rollers 13, 14, designed as a pair of conveying rollers.

Arranged beneath the phased conveying device 11 is a feed device 15. The feed device 15 exhibits lever arms 16, which are secured in a star shape, in each case with one end on a common axis of rotation 17.

Arranged at the free ends of the lever arms 16 are clamping devices 18 (FIG. 4). By rotation about the axis of rotation 17, the clamping devices 18 can be rotated out of a take-up position 19 in the area of the phased conveying device 11 into a welding position 20 in the area of the transport device 33. The clamping devices 18 exhibit clamping jaws 21 with clamping jaw tips 22, which are moved by a pneumatic cylinder 23. The separated closure films 8 are taken up by this clamping device 18. In this situation, the part of the closure film 8, which it is intended to be welded to a pouring element A, projects beyond the clamping jaw tip 22. Centering pins 24 are provided at the free ends of the lever arms 16, which enter into the pouring elements A arranged on composite packages P, and so fix the position of the pouring elements A in a welding position 20, while serving at the same time as counter-holders for a welding device 25, whereby the welding device 25 consists essentially of a heatable welding head 27, which can be actuated by a cylinder 26.

The feed device 15 also exhibits a drive unit 28 in the form of a stepping motor 28, by means of which the star wheel, consisting of the lever arms 16 arranged in a star shape, is displaced in intermittent rotation by means of a vee-belt 29.

Arranged directly beneath the phased conveying device 11 is a cutting device 30, which comprises a pneumatic cylinder 31 and a cutting blade 32. By the extension of the pneumatic cylinder 31, a closure film 8, located between the clamping jaw 21 and the upper lever arm 16, is separated from the closure film strip 7 located above.

Provided beneath the welding device 25 is a transport device 33, indicated only diagrammatically, for the composite packages P, whereby the composite packages P are arranged standing upright in the transport device 33, and exhibit a pouring element A, already applied on their upper side. The distance interval of the pouring elements A to the individual composite packages P in the transport device 33 is adjusted to the distance interval of the centering pins 24 of two adjacent lever arms 16.

The transport device 33 and the feed device 15 are in this situation arranged in relation to one another in such a way that the clamping device 18 in the welding position 20 extends perpendicularly to the plane of the opening of the pouring elements A arranged on the transport device 33. Due to the centering pins 24 on each clamping device 18, it can be ensured that these and the pouring elements A are located congruent to one another in the welding position 20.

Above the composite packages P a rail 34 is arranged in front the welding position 20 seen in the transport direction T of the composite packages, which serves to align in the proper position the composite packages P, and in particular the position on the pouring elements A at which it is intended that the closure films 8 should be welded on, as well as the closure films 8 moving along the rail 34.

The transport device 33 also exhibits a sensor 35, which in general serves to detect packages P with pouring elements A arriving at the transport device 33. Should it happen that no package P arrives, or a package P without pouring element A is transported into the welding station 20, then the feed device 15 will be halted by a signal from the sensor 35.

Due to the stepped rotation of the star wheel by means of the drive unit 28, the next lever arm 16 is brought into the take-up position 19. The next closure film 8 is now also taken up by this lever arm 16.

After further rotational cyclic movements of the star wheel, the closure film 8 first fixed to this is transported into the welding position 20 and, in this situation, is laid laterally at the pouring element A of a composite package P. During the last section of the movement of the lever arm 16 into the welding position 20, the movements of the lever arm 16 and the movement of the composite packing P being transported simultaneously run in synchrony with one another, whereby the closure film 8 and the pouring element A are aligned to one another by means of the rail 34. After the closure film 8 and the pouring element A are located congruent in the welding position 20, the heated welding head 27 is pressed against the free end of the closure film 8, and welded to the pouring element A. For that purpose the centering pin 24 is located in the opening of the pouring element A, and so serves simultaneously as a counter-holder for the welding head 27. Because the clamping device 18 with the closure film 8 in the welding position 20, after 180° rotation, extends perpendicularly to the opening of the pouring element A, the closure film A is secured perpendicular to the opening, which thereafter makes possible the sterilization and filling of the composite package 40, because the closure film 8 remains in the perpendicular position.

During or after the welding of the closure film 8, it is released by the opening of the clamping jaws 27. After the welding process, the composite package P, with the closure film 8 secured to it, is transported further in the next step, so that the next lever arm 22, together with a further composite package P, is rotated into the welding position 20.

The invention claimed is:

1. A method for securing composite films to pouring elements arranged on composite packages, comprising:

infeed of strip material;

punching of closure films out of the strip material;

conveying and separating the closure films into individual pieces;

fixing of the closure film in a clamping device, wherein the clamping device is in a take-up position;

conducting of the closure film from the take-up position into a welding position;

transport of a composite package with a filling element into an area of the welding position;

moving the clamping device along a circular path from the take-up position to the welding position, and securing of the closure film on the filling element by means of a welding device and release of the closure film by the clamping device.

2. The method according to claim 1, wherein the closure films are conveyed as a continuous closure film strip and that separation into individual pieces is effected by cutting the closure film strip.

3. The method according to claim 1, wherein the delivery of the closure films from the take-up position into the welding position is accomplished by pivoting the clamping device about an axle.

4. The method according to claim 3, wherein a rotation takes place in single individual steps.

5. The method according to claim 4, wherein after at least one of the rotations, a further closure film is taken up by a further clamping device.

6. The method according claim 1, wherein the delivery of the closure film into the welding position and the transport of the composite packages with the pouring elements into the area of the welding position is accomplished in movements which run parallel and in synchrony with one another.

7. The method according to claim 6, wherein the closure film and the composite packages with the pouring elements are aligned to one another during the movement running in parallel.

8. The method according to claim 1, wherein the feed device and the transport device are actuated jointly.

9. The method according to claim 1, wherein the transport of the composite packages is monitored by a sensor.

10. The method according to claim 1, wherein clamping jaws of the clamping device are selectively opened and closed as the clamping device moves along the path to move the clamping jaws to fix the closure film in the clamping device and to release the film from the closure device.

11. A device for securing closure films to pouring elements arranged on composite packages, comprising a phased conveying device for conveying the closure films; a feed device; a welding device; and a transport device for transporting the composite packages, wherein the welding device is arranged above the transport device, the feed device includes at least one clamping device for taking up the closure films, the clamping device is provided with clamping jaws adapted to be moved between an open position and a closed position and the clamping device is arranged so as to be movable between a take-up position and a welding position, and the take-up position is turned towards the phased conveying device and the welding position is turned towards the transport device, wherein the feed device conveys the clamping jaws along a circular path past the take-up position and the welding device.

12. The device according to claim 11, wherein the feed device is designed in such a way that the clamping device in the welding position extends in a direction of a middle axis of an opening of the pouring elements arranged on the composite packages.

13. The device according to claim 11, wherein the feed device is provided with at least one lever arm, wherein the lever arm is jointed so as to be pivotable with one end on an axle, and wherein the clamping device is arranged at a free end of the lever arm and turned away from the axle.

14. The device according to claim 13, wherein the feed device is provided with several lever arms and the lever arms are arranged in star fashion about the axle.

15. The device according to claim 14, wherein the lever arms arranged in star fashion are rotatable about the axle.

16. The device according to claim 11, wherein a cutting device is provided between the phased conveying device and the feed device.

17. The device according to claim 11, wherein a punching or stamping device is provided before the phased conveying device in relation to the direction of conveying of the closure films.

18. The device according to claim 11, wherein the transport device is adapted for the transport of composite packages standing upright, provided with pouring elements, wherein the pouring elements are arranged on top.

19. The device according to claim 18, wherein a direction of transport of the composite packages with the pouring elements in the transport device and a direction of movement of the clamping devices in an area of the transport device run parallel to one another.

20. The device according to claim 19, wherein an axle runs perpendicularly to the direction of transport and is arranged in a plane parallel to a transport plane.

21. The device according to claim 19, wherein the transport device is provided with a rail for parallel alignment and guidance of a filling element and the closure film.

22. The device according to claim 11, wherein the transport device is provided with a sensor for the detection of an incoming composite package with a filling element.

23. The device according to claim 11, wherein the phased conveying device exhibits two conveying rollers, wherein the conveying rollers are in contact with one another.

24. The device according to claim 11, wherein the closure films comprise aluminium foil.

25. A device for securing closure films to pouring elements arranged on composite packages, comprising a phased conveying device for conveying the closure films; a feed device having at least one lever arm; a welding device; and a transport device for transporting the composite packages, wherein the welding device is arranged above the transport device, the feed device includes at least one clamping device for taking up the closure films, the clamping device is provided with clamping jaws adapted to be moved between an open position and a closed position and is arranged so as to be movable between a take-up position and a welding position, and the take-up position is turned towards the phased conveying device and the welding position is turned towards the transport device, wherein the clamping jaws in the closed position press against the at least one lever arm.

26. The device according to claim 25, wherein the clamping jaws are moved pneumatically.

27. A device for securing closure films to pouring elements arranged on composite packages, comprising a phased conveying device for conveying the closure films; a feed device provided with several lever arms, the lever arms arranged in star fashion about the axle, the lever arms jointed so as to be pivotable with one end on an axle; a welding device; and a transport device for transporting the composite packages, wherein the welding device is arranged above the transport device, the feed device includes at least one clamping device for taking up the closure films, the clamping device is arranged so as to be movable between a take-up position and a welding position, and the take-up position is turned towards the phased conveying device and the welding position is turned towards the transport device and wherein the clamping device is arranged at a free end of the lever arms and turned away from the axle, wherein the lever arms are provided with a centering pin in the area of the clamping device, pointing away from the axle.

* * * * *